US008944300B1

(12) United States Patent
Kaufman

(10) Patent No.: US 8,944,300 B1
(45) Date of Patent: Feb. 3, 2015

(54) WEARABLE UMBRELLA

(71) Applicant: Alan Kaufman, Boca Raton, FL (US)

(72) Inventor: Alan Kaufman, Boca Raton, FL (US)

(73) Assignee: Nubrella Enterprises, LLC, Waltham, MA (US)

( * ) Notice: Subject to any disclaimer, the term of this patent is extended or adjusted under 35 U.S.C. 154(b) by 0 days.

(21) Appl. No.: 13/856,148

(22) Filed: Apr. 3, 2013

Related U.S. Application Data

(60) Provisional application No. 61/620,116, filed on Apr. 4, 2012.

(51) Int. Cl.
*A45B 11/02* (2006.01)
*A45B 23/00* (2006.01)

(52) U.S. Cl.
CPC ..... *A45B 23/00* (2013.01)
USPC ..... 224/190; 224/187; 224/576; 224/628; 135/16

(58) Field of Classification Search
USPC ..... 224/187, 190, 576, 153, 186, 188, 189, 224/628, 633, 635; 2/410; 135/96, 20.1, 135/34.2, 16; 297/184.17
See application file for complete search history.

(56) References Cited

U.S. PATENT DOCUMENTS

| | | | | | |
|---|---|---|---|---|---|
| 1,803,538 | A * | 5/1931 | Pistole | 224/187 |
| 4,170,242 | A * | 10/1979 | Caso | 2/410 |
| 5,896,590 | A * | 4/1999 | Fleisch | 2/455 |
| 6,024,264 | A * | 2/2000 | Java | 224/576 |
| 6,076,539 | A * | 6/2000 | Richardson | 135/20.1 |
| 6,247,482 | B1 * | 6/2001 | Muis | 135/16 |
| D590,145 | S * | 4/2009 | Kaufman | D3/5 |
| 2006/0219279 | A1 * | 10/2006 | Kaufman | 135/20.1 |
| 2007/0262103 | A1 * | 11/2007 | Blakley et al. | 224/190 |

* cited by examiner

*Primary Examiner* — Brian D Nash
*Assistant Examiner* — Corey Skurdal
(74) *Attorney, Agent, or Firm* — Daniel S. Polley, P.A.

(57) ABSTRACT

A wearable umbrella which is worn by the intended user of the umbrella and once in an opened position, the umbrella remains in the opened position without requiring the user to have to use his or hands to hold the umbrella. The umbrella generally comprises a canopy supported by a plurality of curved ribs that are pivotable from a down/closed position to a fully extended/"in use" position. When fully extended the pivot mechanisms lock in place so that canopy stays open on its, thus freeing the wearer's hands. The umbrella is supported and secured to the wearer through a back panel and adjustable waist and shoulder straps. A support member which can also be attached to the back panel supports the pivot mechanisms, curved ribs and canopy.

20 Claims, 10 Drawing Sheets

WEARABLE UMBRELLA

This application claims the benefit of and priority to U.S. application Ser. No. 61/620,116, filed Apr. 4, 2012, which is incorporated by reference herein in its entirety.

FIELD OF THE INVENTION

The present invention relates generally to umbrellas and more particularly to an umbrella that is worn by a person.

BACKGROUND OF THE INVENTION

Portable umbrella's are well known around the world and are used by people to prevent rain from falling on their heads and shoulders. Umbrellas are also widely known to be used to block the sun. The word umbrella comes from the Latin word 'umbra' which means shade or shadow. The standard umbrella includes a central shaft with a handle at a lower end and with ribs that are hingedly and radially extending from a top most portion of the central shaft. A rain resistant fabric is attached to the ribs. When the ribs are in the closed position, the ribs and attached fabric is in close proximity to the central shaft. When the umbrella is in the use position, the ribs and attached fabric are spread out radially and the resulting canopy forms a hand-held rain resistant cover for a person as they walk in the rain.

Umbrella's come in a variety of shapes and sizes. However, a common feature is that they need to be held in one hand by the user when in use. Even when not in use and there is a threat of inclement weather, the umbrella must be carried either by hand or in a carry case of some sort. This deficiency makes it nearly impossible and potentially dangerous for the user to use the standard umbrella when performing activities that require two hands, such as riding a bicycle or carrying a large package. Additionally, holding a standard umbrella up for long periods of time can be tiring; such as when attending a ball came that is taking place in the rain. Games can last three hours or more, which is a long time to have to hold an umbrella up in its normal use positron.

Umbrellas are also commonly known to either fail in strong windy conditions or as what most people refer to "invert". This problem occurs with any size umbrella due to the structure acting as a sail. Users have been facing this problem for centuries.

The present invention wearable umbrella is directed to overcoming these problems associated with traditional hand-held umbrellas and can be used in all weather conditions including extreme heat.

SUMMARY OF THE INVENTION

The present invention provides a wearable umbrella that allows the user to have the availability of an umbrella at all times, while at the same time not requiring the user to use or both of his or her hands to maintain the umbrella in position. The wearable umbrella generally comprises a flexible rain resistant canopy secured to a canopy frame. The canopy frame is specifically designed to be in an oval shape so aerodynamically wind flows over and around the canopy completely denying, or significantly reducing, any ability to invert. The canopy frame preferably comprises a plurality of curved ribs. The wearable umbrella also comprises a first and second pivot or rotating members and a back panel support member.

The flexible sheet constituting the canopy can be secured to the curved ribs such that they are evenly spaced apart from each other when in the use position and sized to cover a person's head and shoulders. The flexible sheet can be cut, sewn and attached to the curved ribs by conventional means. Preferably, the canopy can be taught and wrinkle free when the curved ribs are fully extended in the "open" "in use" position. The user can have several options of the amount of coverage they desire by how much they extend the canopy over their head.

The wearable umbrella can be relatively lightweight, compact and take up little space while being worn in the closed position by a wearer. The umbrella functions and stores similar to a raincoat hood going back and forth when needed and storing down the users back when not. However, once the canopy is moved to its extended "in use" position, the wearable umbrella of the present invention provides an effective head and body rain covering. If provided for in the material selected for the canopy, the canopy when in use can also provide the wearer protection from the sun.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
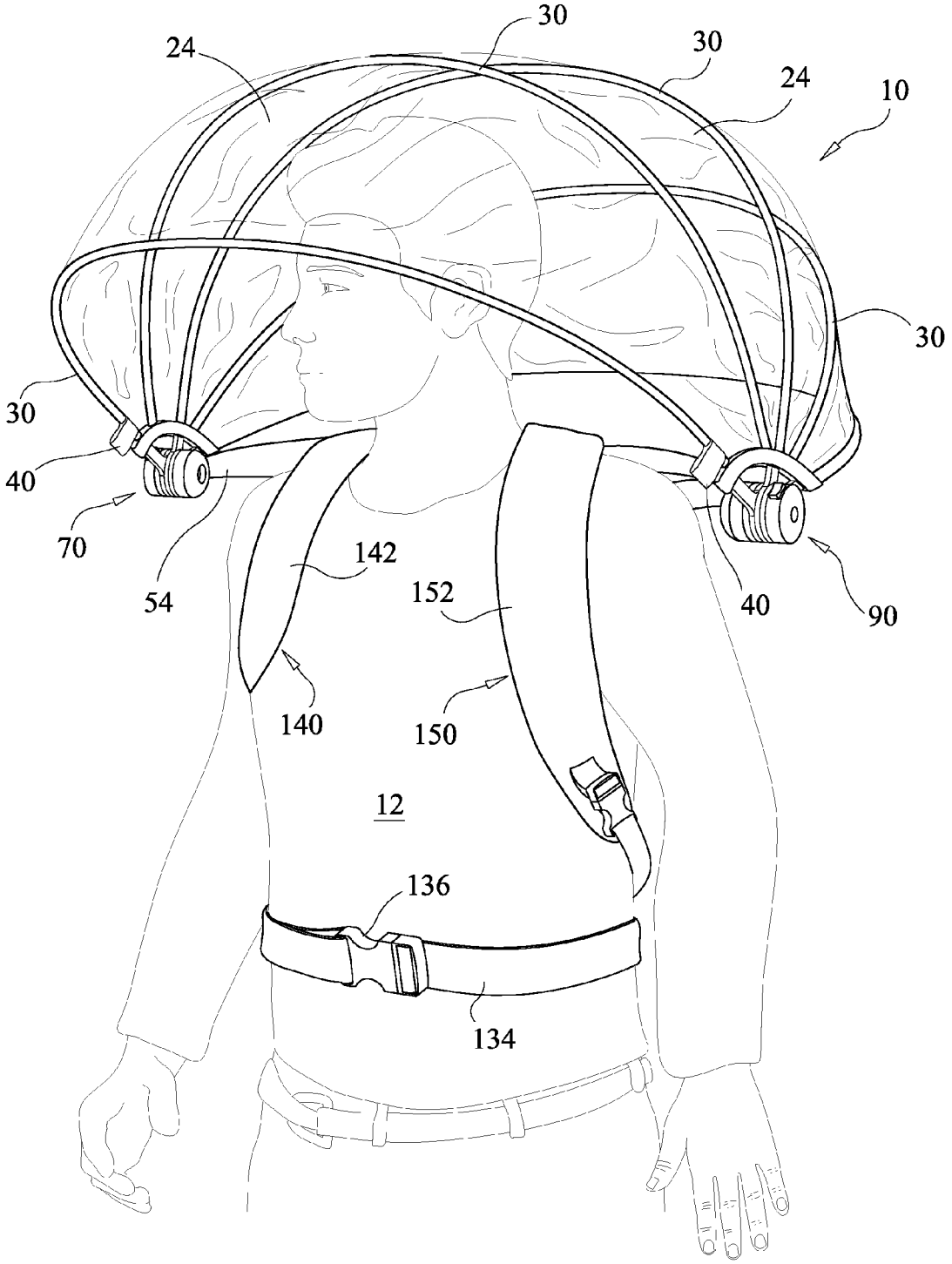
FIG. 1 is a front perspective of a wearable umbrella in accordance with a first embodiment of the present invention showing a person wearing the present invention by use of a plurality of securing straps and with the invention in the fully extended "in use" position for the first embodiment.

Detailed descriptions of the preferred embodiment are provided herein. It is to be understood, however, that the present invention may be embodied in various forms. Therefore, specific details disclosed herein are not to be interpreted as limiting, but rather as a representative basis for teaching one skilled in the art to employ the present invention in virtually any appropriately detailed system, structure or manner.

As seen in FIGS. 1 through 8, a first embodiment of the present invention wearable umbrella is shown and generally designated as umbrella 10. Umbrella 10 comprises three main components, namely, a collapsible canopy and frame assembly generally designated as reference numeral 20, a pivot and frame securement assembly generally designated as reference numeral 50 and a body secured support back panel or vest member generally designated as reference numeral 130. Each of these three components will be described in more detail below.

Canopy and frame assembly 20 comprises a canopy 24 and a plurality of canopy supports that in a preferred embodiment can be can be a plurality of curved canopy support ribs or rods 30 (collectively "ribs 30"). Canopy 24 can be secured to curved ribs 30 by any conventional means. Securement examples include, but are not limited to, sewing, mechanical fasteners, or other forms of mechanical engagement known to those skilled in the art. Curved ribs 30 form the support frame for canopy 24. A first end 32 of each curved rib 30 can be provided with a first insert or tab 34 which is sized to be inserted and received within a pocket or opening of a corresponding tube located on a first side of pivot and frame securement assembly 50 for securing first end 32 of each curved rib 30 to the first side of pivot and frame securement assembly 50. Similarly, a second end 36 of each curved rib 30 can be provided with a second insert or tab 38 which is sized to be inserted and received within a pocket or opening of a corresponding tube located on the opposite side of pivot and frame securement assembly 50 for securing second end 36 of each curved rib 30 to the second side of pivot and frame securement assembly 50.

Canopy 24 can be made from a water resistant material, such as, but not limited to, vinyl. Preferably, a clear vinyl can be provided. Though not limiting, it is within the scope of the invention that a portion of canopy 24 can be made of a non-clear or opaque material. Other water resistant materials that will allow canopy 24 to be collapsed or folded and opened in accordance with the functions of the present invention can be used and are considered within the scope of the invention. In addition to protection from when it's raining, the present invention wearable umbrella 10 can also provide protection from the sun, especially for an individual who is required to be outside for an extended period of time, though such is not considered limiting. As such, the material chosen for canopy 24 can have sun reflective and/or UV protection characteristics.

Though not considered limiting, each carved rib 30 can be made from a flexible material such as, but not limited to, fiberglass such that curved ribs 30 are provided with a natural spring quality and can be spread out in the "canopy open" position. Other materials that will allow curved ribs 30 to be pivoted, opened, collapsed, etc. in accordance with the functions of the present invention can be used and are considered within the scope of the invention. The chosen material for curved ribs 30 can preferably also be a relatively strong and resilient material, such that in the "canopy open" position, curved ribs 30 can somewhat bend and/or flex to absorb wind, but without breaking or disfiguring. The material chosen for curved ribs 30 is also preferably resilient to rust and/or corrosion. Though fiberglass has been identified as one potential material for constructing curved ribs 30, other non-limiting examples can be stainless steel, aluminum, titanium, carbon fiber, graphite, plastics or other metals or plastics known to those skilled in the art.

Though five (5) curved ribs 30 are shown in the drawings, such is not considered limiting, and a fewer or larger number of curved ribs 30 can be used with the present invention wearable umbrella and providing another number of curved ribs 30, in addition to five curved ribs 30, are also considered within the scope of the invention.

The plurality of curved ribs 30 extend from a first "closed" position (see FIG. 6) and can be pivoted to second "opened position (see FIG. 1). The front most curved rib 30 can be have one or more tabs 40 secured thereto to facilitate the wearer moving (pivoting or rotating) the canopy and frame assembly 20 from a closed position to its fully opened position shown in Figures. In a preferred embodiment, a tab 40 can be secured to each side of the front most curved rib 30 by conventional means, such as sewing, and at a location where wearer 12 can reach and grab tabs 40 in order to pull the canopy and frame assembly 20 forward to the fully opened position, where it will lock and remain such position, until manually released by wearer 12. Though two tabs 40 are shown in FIG. 1, it is also within the scope of the invention that only one tab 40 is provided either on the right side or the left side of the front most curved rib 30.

Figure 2:
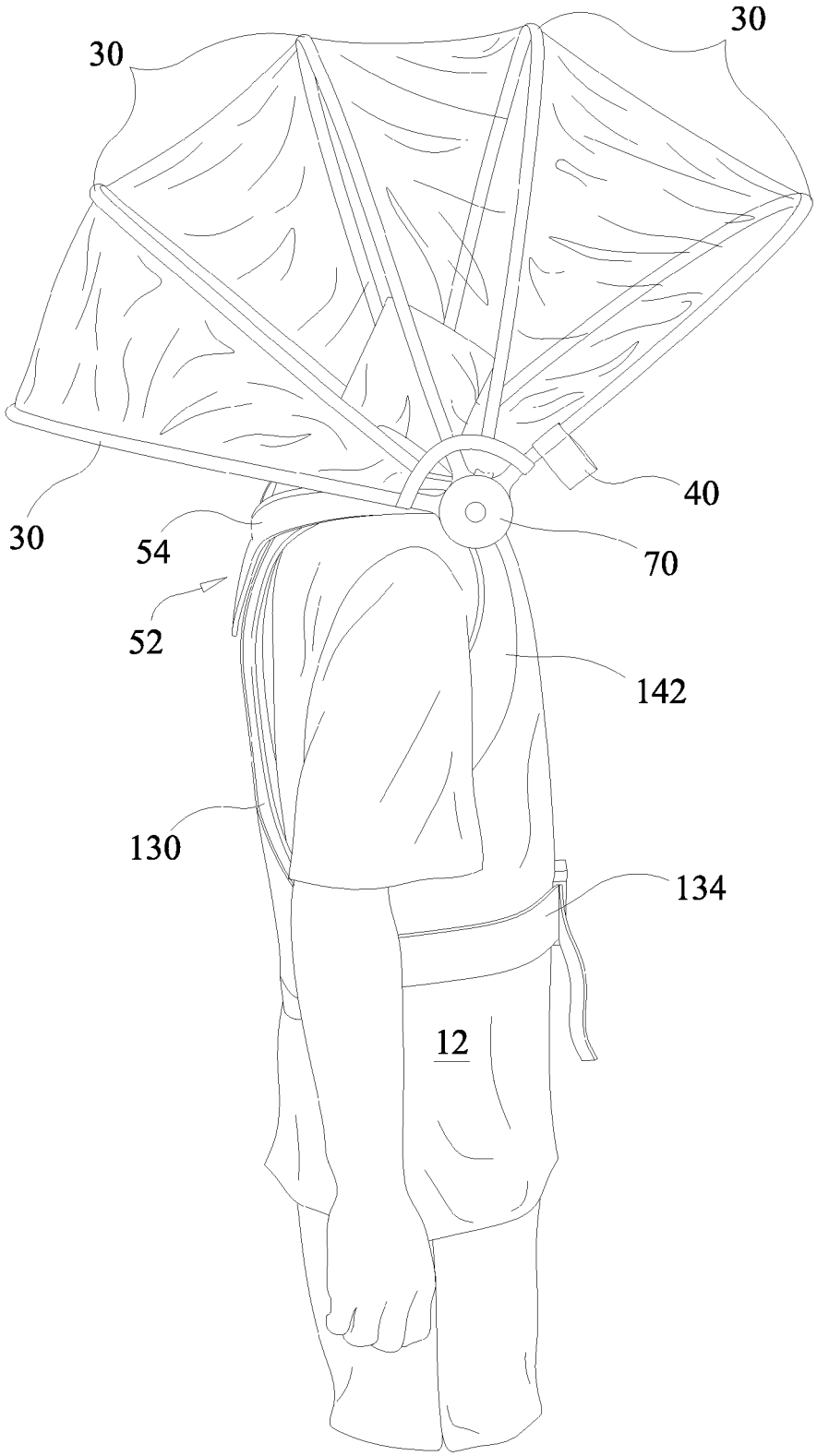
FIG. 2 is a side view of a person wearing the wearable umbrella of FIG. 1 with the invention in one of the deployed "in use" positions.
Figure 3:
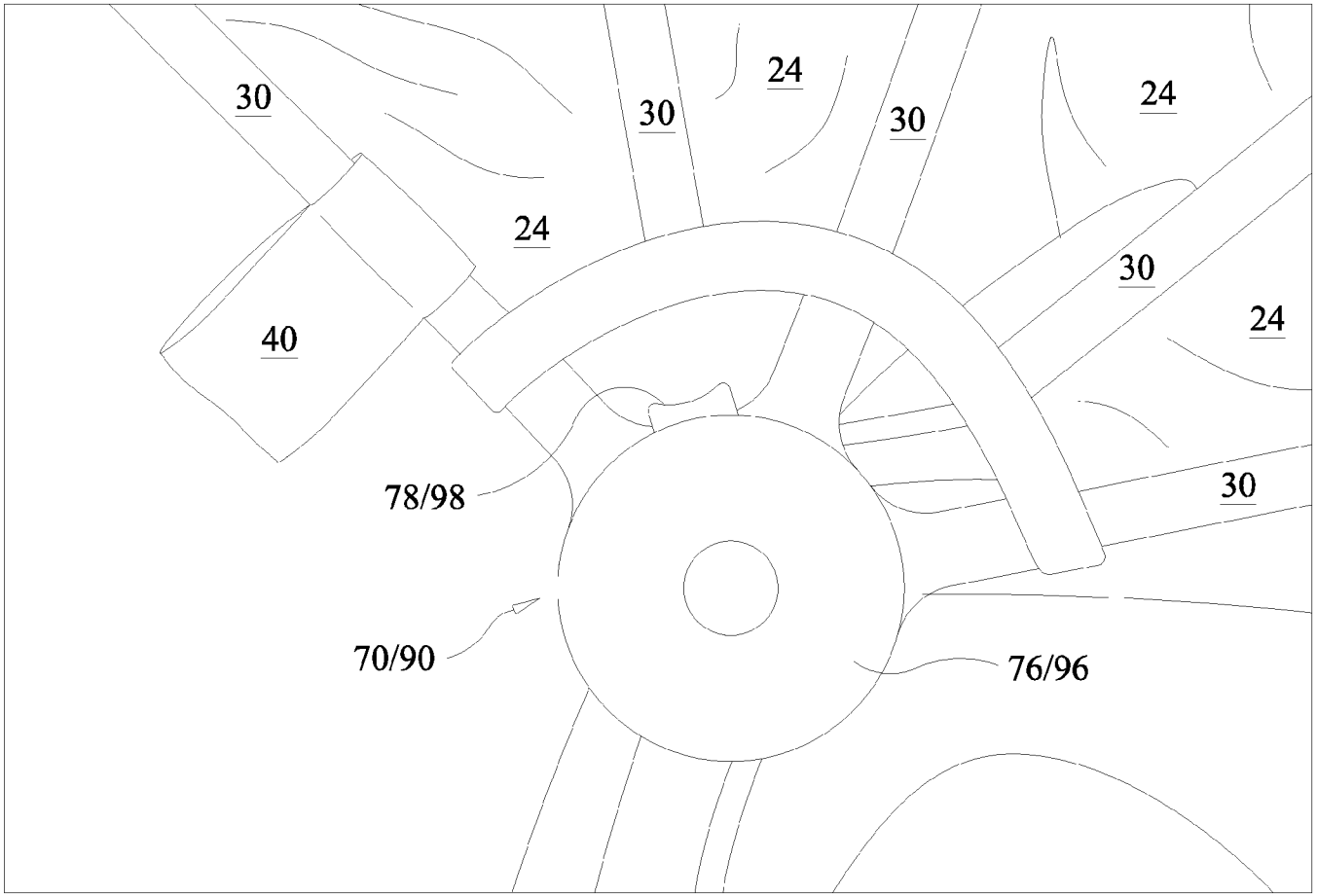
FIG. 3 is a close up side view of showing a pivot assembly for the wearable umbrella of FIG. 1.
Figure 4A:
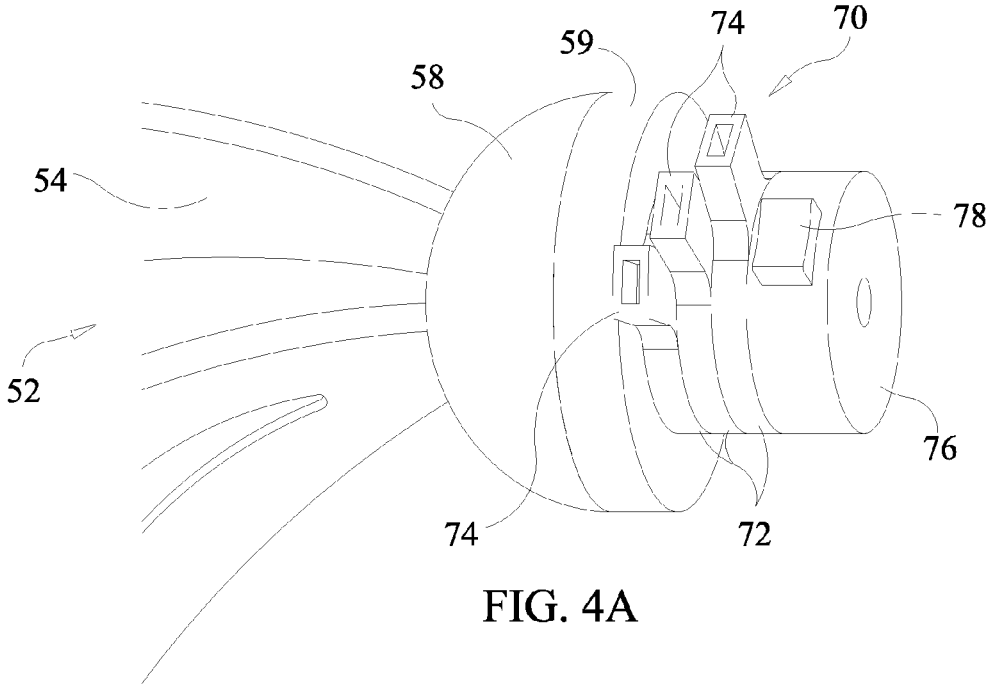
FIGS. 4*a*-4*d* illustrate various views of portions of the pivot assembly partially exploded and fully exploded.
Figure 4B:
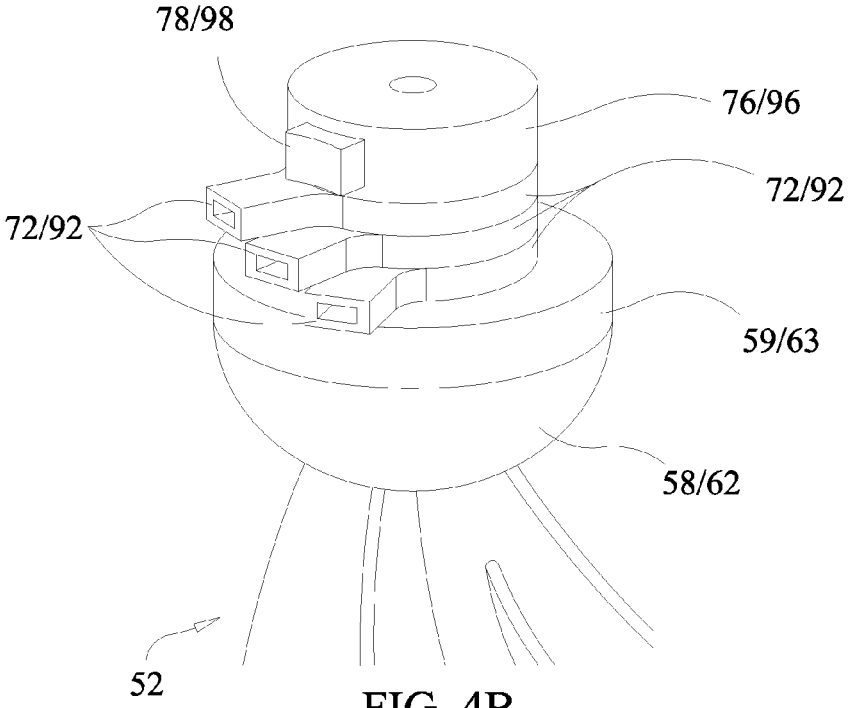
Figure 4C:
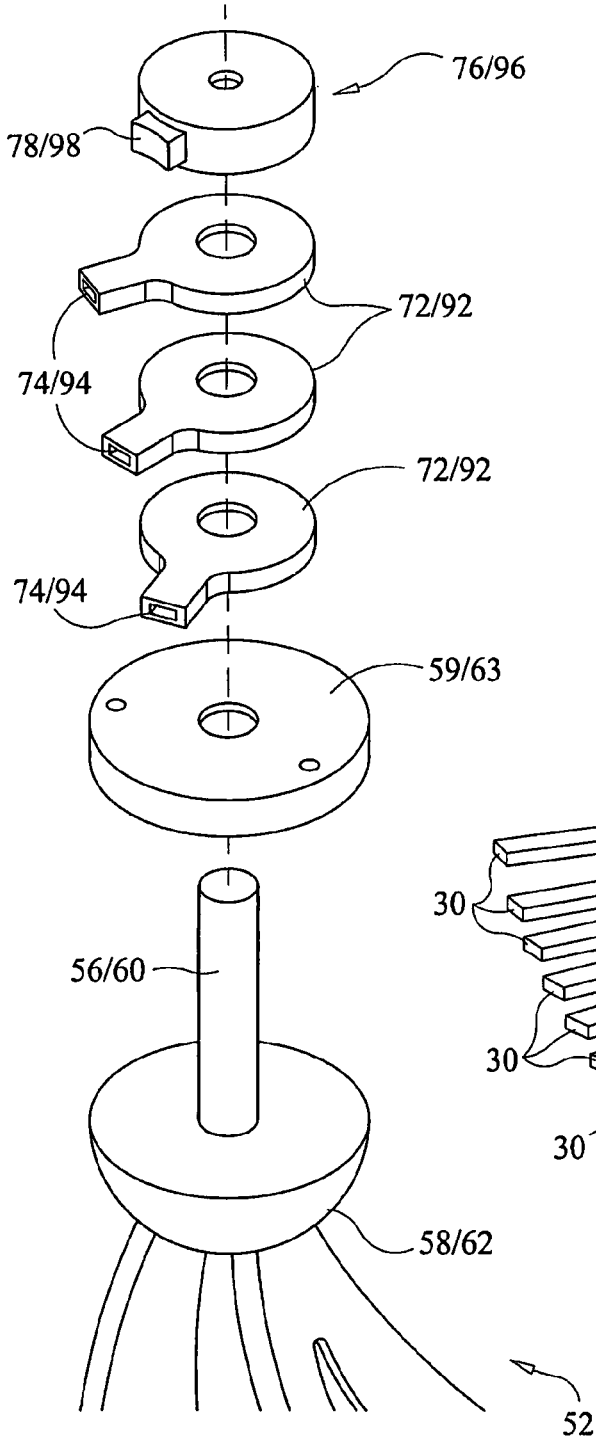
Figure 4D:
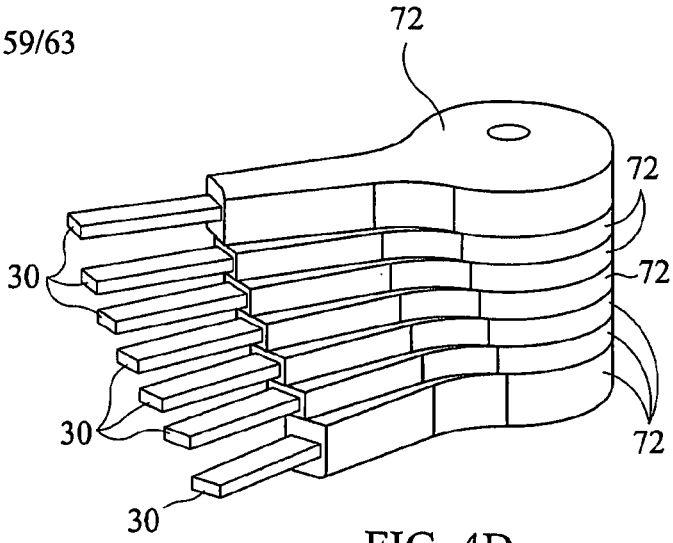
Figure 5:
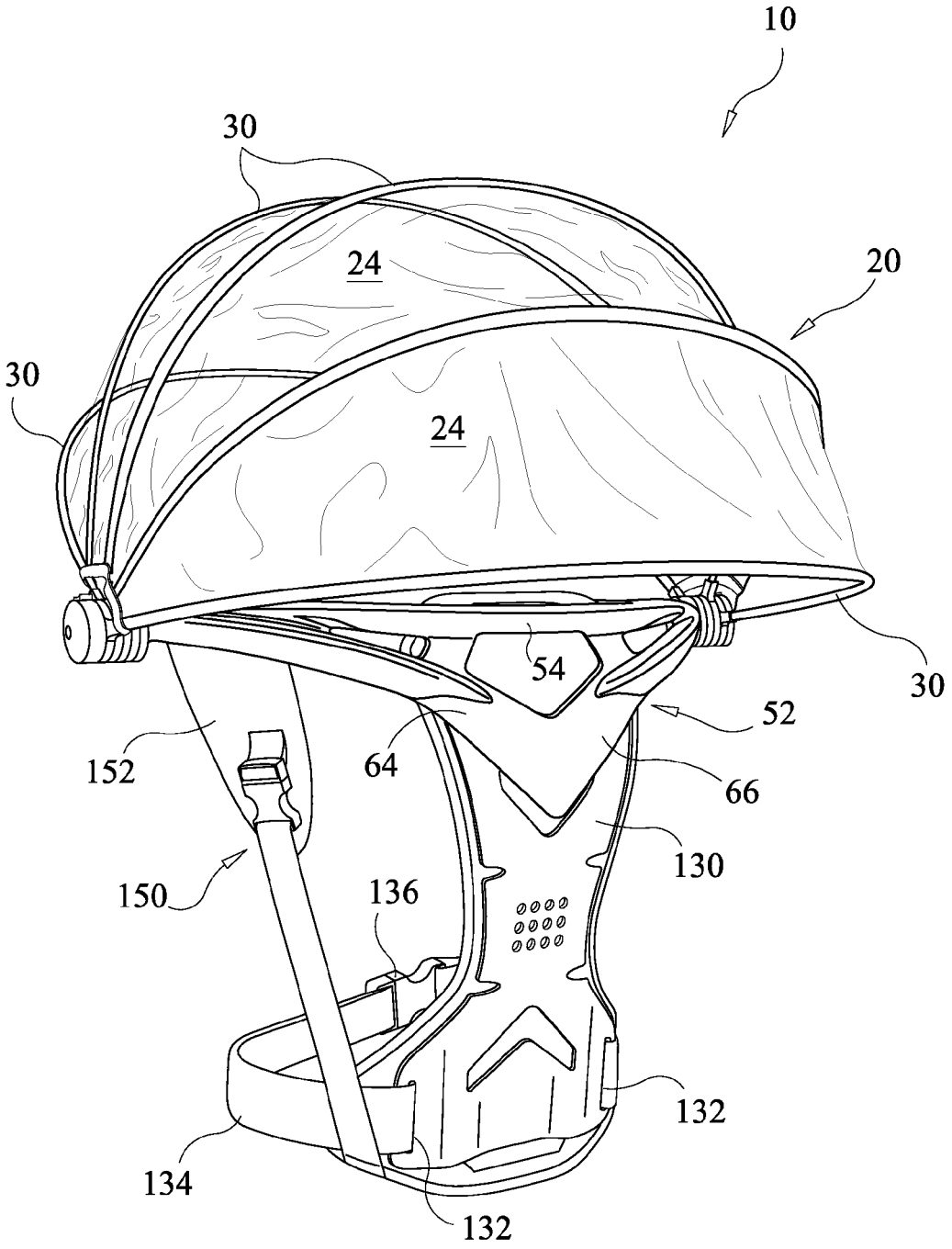
FIG. 5 is a back perspective view of the wearable umbrella of FIG. 1 shown in a fully extended "in use" position.
Figure 6:
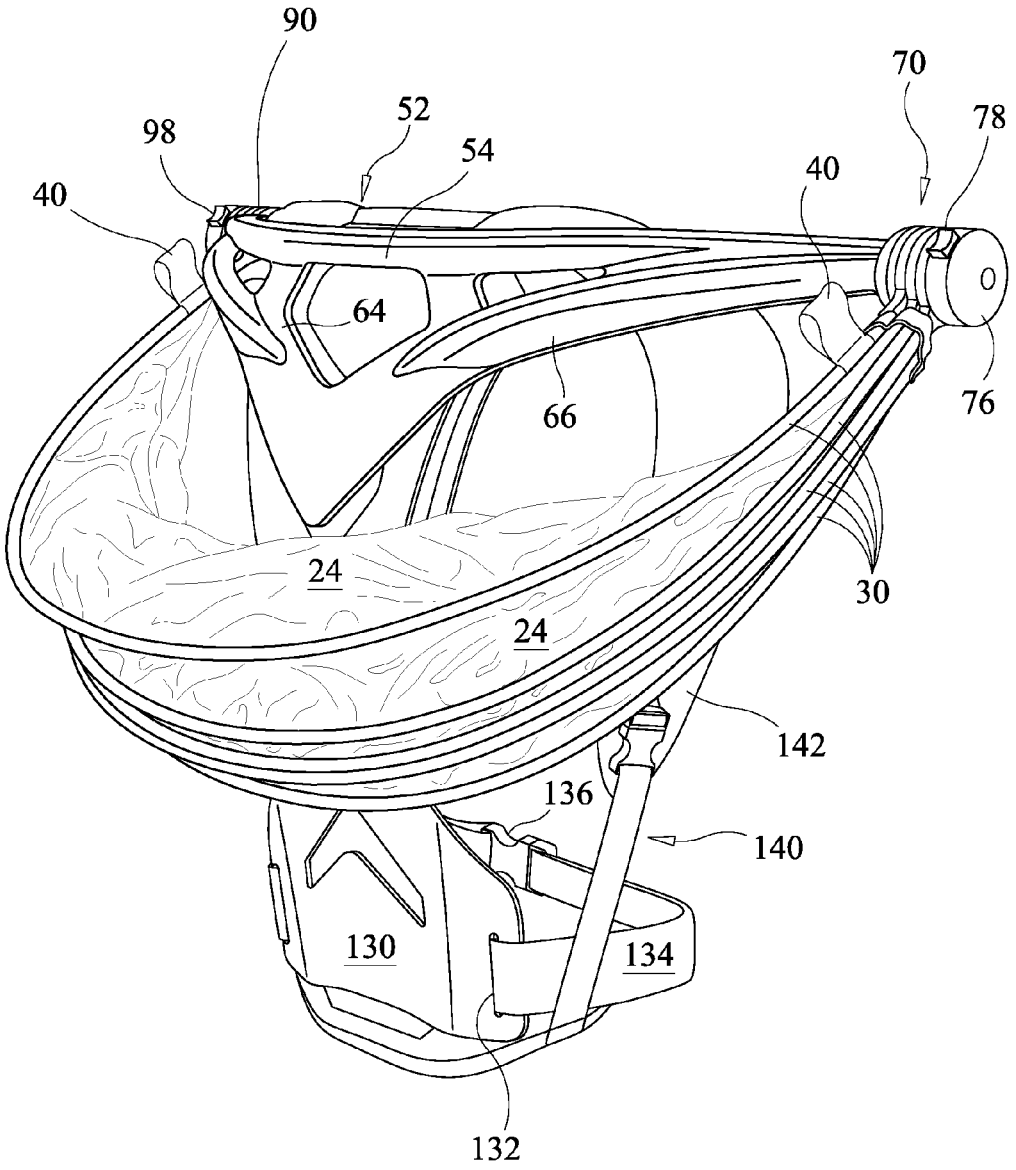
FIG. 6 is a back perspective view of the wearable umbrella of FIG. 1 shown in down "closed" position.
Figure 7:
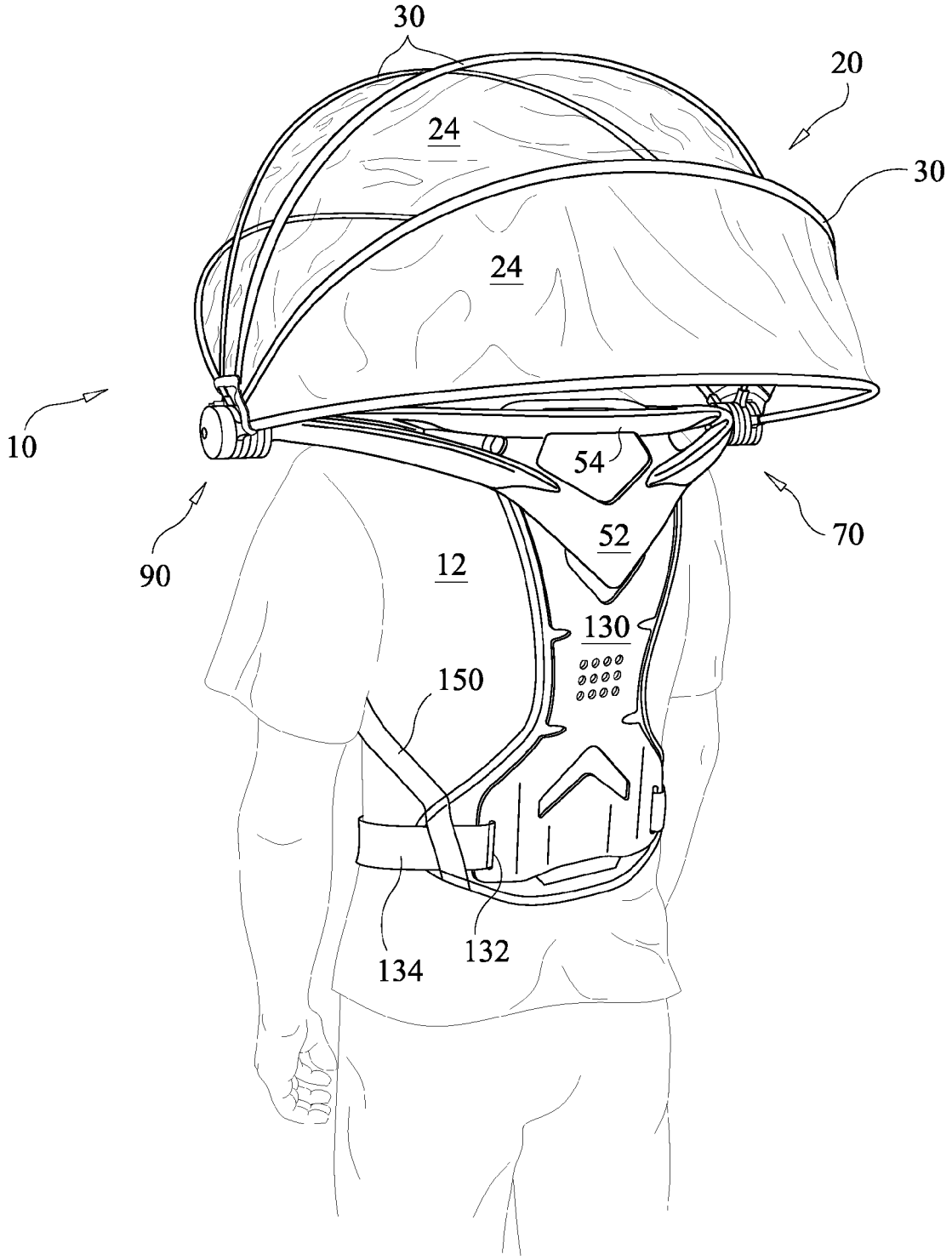
FIG. 7 is a back perspective view of the wearable umbrella of FIG. 1 showing a person wearing the invention and the invention in a deployed "in use" position.

As curved ribs 30 are interconnected through all being secured to canopy 24, the movement of the front most curved rib 30, by pulling on tabs or fabric loops 40 by wearer 12, will cause all of the curved ribs to move (pivot or rotate) to their proper final extended position as seen in FIGS. 1 and 2. Canopy 24 can be a single piece of material sufficient in size to be secured to all curved ribs 30, or can be a plurality of pieces materials, which each piece of material secured to two adjacent curved ribs 30. As a non-limiting example, where five curved ribs 30 are provided, there can be four pieces of materials.

Though it is preferred to have tabs 40 being made of material such as cloth, fabric etc. more rigid materials can be used for the tabs or fabric loops 40 (collectively "tabs"). Additionally, in lieu of tabs 40, protrusions can extend out from the foremost curved rib 30 that can also be grabbed by wearer 12 and serve the same purpose of tabs 40. The protrusions can be separately attached to foremost curved rib 30 or can be monolithically formed with the foremost curved rib 30. It is also within the scope of the invention to not provide any grabbing tabs, protrusions, etc. and that the foremost curved rib 30 can be positioned in the closed configuration where the wearer can reach back grab the foremost curved rib 30 and pull canopy and frame assembly 20 into the opened configuration.

Thus, whether tab/fabric loop 40 or a protrusion, metal piece, rubber knob or other item, it is preferred that some item be provided for the user to grab to pull the canopy over their head. Where a fabric loop 40 is provided on each side, the two looped fabric pieces 40 are grabbed by wearer 12 with each hand to deploy the canopy over his or her head. As mentioned above, other items or configurations for deploying the canopy can also be used and are considered within the scope of the invention. Though fabric loops 40 are preferably provided with the front most curved rib 30, such is not considered limiting, and the fabric loops or other grabbing item can be provided with one of the other curved ribs 30 instead of or in addition to the front most curved rib 30.

Pivot and frame securement assembly 50 is positioned at or adjacent to the shoulder area of wearer 12 and an upper portion 54 of assembly 50 can rest on the shoulder area and behind the neck of wearer 12 and wrap around wearer 12 such that the pivot points for the plurality of curved ribs can be located at or adjacent to the front shoulder areas of wearer 12. The front shoulder area is not considered limiting and other locations with respect to wearer 12 that allow the wearable umbrella to be operated by wearer 12 can also be selected and are considered within the scope of the invention.

Assembly 50 generally comprises a canopy support member 52 and a first pivot member 70 and a second pivot member 100. Support member 52 can be substantially centrally positioned with respect to wearer 12 and can be shaped similar to an inverted triangle, though such is not considered limiting, and any other shapes that will provide support for the first pivot member 70 and second pivot member 100 and canopy and frame section 20 attached to first pivot member 70 and second pivot member 100 can be chosen for central support member 52 and are considered within the scope of the invention. Upper portion 54 of the inverted triangle support member 52 can be somewhat curved in shape such that each end of upper portion 54, and the pivot mechanisms for wearable umbrella 20, are positioned at the front shoulder areas of wearer 12.

Support member 52 helps to support and stabilize canopy and frame assembly 20 when canopy and frame assembly 20 is in its "opened" position while as seen in FIG. 1. Support member 52 can also help to relieve some of the weight of canopy and frame assembly 20. As support member 52 in connection with back panel 130 helps to maintain and stabilize canopy and frame assembly 20 in its "opened" position, support member 52 allows wearer 12 to enjoy the benefits of canopy 24 in a hands free mode (i.e. wearer 12 does not have to hold canopy 24 over his or her head with one hand).

A first shaft member 56 and stop member 58 can be provided at a first end of central support member 52 and a second shaft member 60 and second stop member 62 can be provided at a second top end of central support member 52. The other two legs 64 and 66 of central support member 52 can provide further support to canopy and frame assembly 20 and can also provide further securement area for securing the central support member 52 to back panel member 130.

First pivot member 70 can be secured to first shaft member 56 and second pivot member 100 can be secured to second shaft member 60. A first plurality of curved rib end connectors 72 can be provided and secured to first shaft member 56 and a second plurality of curved rib end connectors 92 can be provided and secured to second shaft member 60. Preferably, the number of first curved rib end connectors 72 and the number of second curved rib end connectors 92 correspond to the number of curved ribs 30 provided. The first end of each curved rib 30 can be inserted, contained and retained within an opening 74 of an associated curved rib end connector 72. Similarly, the second end of each curved rib 30 can be inserted, contained and retained within an opening 94 of an associated curved rib end connector 92.

The ends of curved ribs 30 can be retained within associated connectors 72 and 92 by any conventional means such as by force fitting, crimping, welding, gluing or other forms of mechanical engagement known to those skilled in the art. Connectors 72 and 92 can be made of metal, plastic or other materials known to those skilled in the art and are provided within a passageway having diameter at least slight larger than the outer diameter of first shaft member 56 and second shaft member 60, respectively, such that first shaft member 56 can be inserted through the passageways of connectors 72 and second shaft member 60 can be inserted through the passageways of connectors 92 when assembling pivot members 70 and 100. Though secured to first shaft member 56, connectors 72 are pivotable around first shaft member 56. Similarly, connectors 92 are pivotable around second shaft member 60. Spacers 59 and 63 can also be provided on first shaft member 56 and second shaft member 60, respectively.

Connectors 72 can be positioned on first shaft member 56 such that the connector 72 that receives the first end of the front most curved rib 30 is the innermost connector 72 and abuts stop member 58. Similarly, connectors 92 can be positioned on second shaft member 60 such that the connector 92 that receives the second end of the front most curved rib is the innermost connector 92 and abuts stop member 62. After all connectors 72 are positioned along first shaft member 56 a first end cap 76 can be secured at the outer end of first shaft member 56 by any known conventional fastening mechanism, such as, but not limited to, a bolt and nut combination. Once secured to first shaft member 56, first end cap 76 acts as a stop member at the outer end of first shaft member 56 in order to retain connectors 72 in position along first shaft member 56. Similarly, after all connectors 92 are positioned along second shaft member 60 a second end cap 96 can be secured at the outer end of second shaft member 60 by any known conventional fastening mechanism. Once secured to second shaft member 60, second end cap 96 acts as a stop member at the outer end of second shaft member 60 in order to retain connectors 92 in position along second shaft member 60.

Once canopy 24 has been pulled forward by wearer 12 to the open/extended position for the first embodiment (i.e. over the wearer's head but not directly in front of the wearer's face—See FIG. 1), canopy 24 is positioned such that it covers the head and shoulder area of wearer 12, but does not extend directly in front of wearer 12 such that wearer 12 is provided with an open front (See FIGS. 1 and 2). Thus, the view of wearer 12 is not hampered or hindered by any water, condensation, din, fogging that could accumulate on canopy 24. By also providing an open front, air is allowed to enter within the canopy coverage area and provide a cooling effect on wearer 12.

Through an internal convention spring/detent or other locking mechanism within pivot member 70 and 90, once canopy 24 has been pulled or otherwise moved into its extended position, the internal mechanism activates to lock canopy 24 in the extended position without wearer 12 having to hold onto tabs 40. In order to close canopy 24 back to its closed/pivoted downward position, a button 78 associated with pivot member 70 and a button 98 associated with pivot member 90 are pressed, which releases the locking connection and causes an internal spring inside pivot member and an internal spring inside pivot member 90 to automatically push the canopy downward back behind wearer 12 (See FIG. 6). Other conventional locking, release and automatic return mechanisms known to one skilled in the art can be used and are considered within the scope of the invention. Furthermore, in lieu of buttons 78 and 98, other conventional activation devices can be used and are also considered within the scope of the invention.

Though not preferred, it is also considered within the scope of the invention, the return of canopy 24 to its closed position can be manually performed by wearer 12. In this alternative embodiment, buttons 78 and 98 can still be pressed to release the locked open position of canopy 24 and wearer 12 then manually pushes curved ribs 30 with sufficient force to cause curved ribs to fall downward to their closed position shown in FIG. 6.

Central support member 52 can be secured to back panel 130 by any conventional means, such as, welding, glues, mechanical fasteners etc. The securement relationship between support member 52 and back panel 130 can be permanent or removable. Additionally, it is also within the scope of the invention to monolithically form support member 52 and back panel 130 together as a one piece member.

Back panel 130 can be provided with a plurality of slots 132 for feeding through a waist strap 134. A male and female side release buckle assembly 136 can be secured to strap 134 by conventional means and are provided for tightening and adjusting waist strap 134 in accordance with the waist size of wearer 12. In lieu of side release buckle assembly 136 other buckle mechanisms and other belt connector and other fasteners can be used and all are considered within the scope of the invention.

A first side shoulder strap 140 can be secured at a first end to a first side bottom portion of back panel 130 or waist strap 134 and a second side shoulder strap 150 can be secured at a first end to a second side bottom portion of back panel 130 or waist strap 134. The opposite end of first side strap 140 can be secured to a first side top portion of back panel 130 and the opposite end of second side strap 150 can be secured to a second side top portion of back panel 130, all by conventional means. First side strap 140 can include a padded or larger portion 142 which rests upon the first shoulder area of wearer 12. Similarly, second side strap 150 can include a padded or larger portion 152 which rests upon the second shoulder area of wearer 12. Each side strap can be provided with an adjustable buckle, tri-glide, etc. to adjust the length of side straps 140 and 150 in accordance with the size of wearer 12. Besides providing support, back panel 130 serves as a manifold or platform for securing the various straps and support members of wearable umbrella 10.

Back panel 130 can be substantially vertically disposed or orientated and can be sized to cover and/or and be in intimate contact with the rear surface of the torso of wearer 12. First shoulder strap 140 can be fixedly attached to a left end of the upper portion of back panel 130 and second shoulder strap 150 can be fixedly attached to a right end of the upper portion of back panel 130. Back panel or back brace 130 can be provided with padding or have portions thereof made from a softer material for comfort purposes. Back panel or back brace can provide a substantially flat surface and can be preferably made from plastic, though such is not considered limiting and other materials can be used and are considered within the scope of the invention.

Wearable umbrella 10 can be held in place on wearer 12 through first and second shoulder straps 140 and 150, waist strap 134 and back panel 130.

Figure 8:
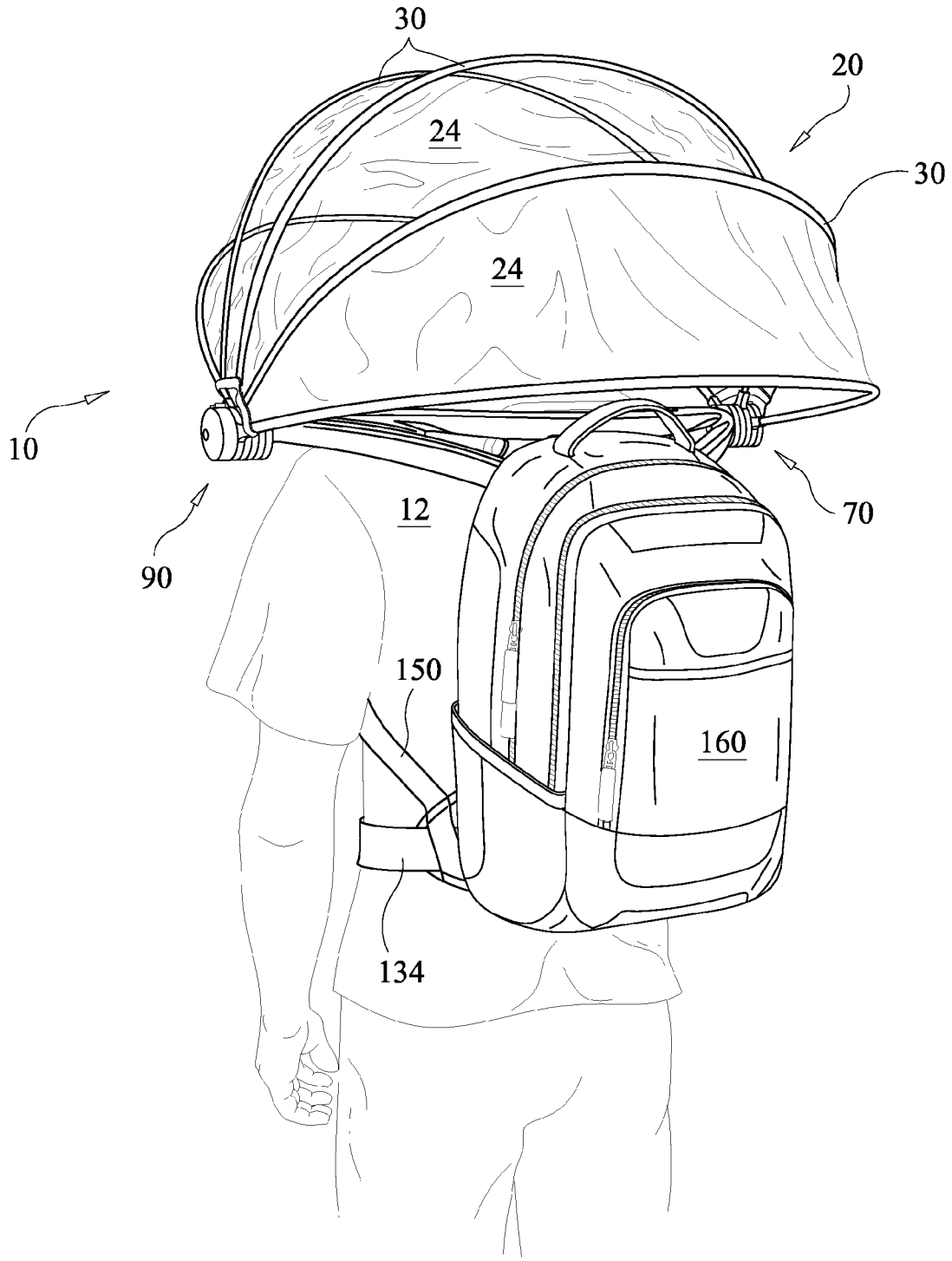
FIG. 8 is a back perspective view of the wearable umbrella of FIG. 1, but also including a backpack secure to the back panel.

FIG. 8 illustrates wearable umbrella 10 with the addition of backpack 160 also secured to back panel 130 by any conventional securement mechanism.

Figure 9:
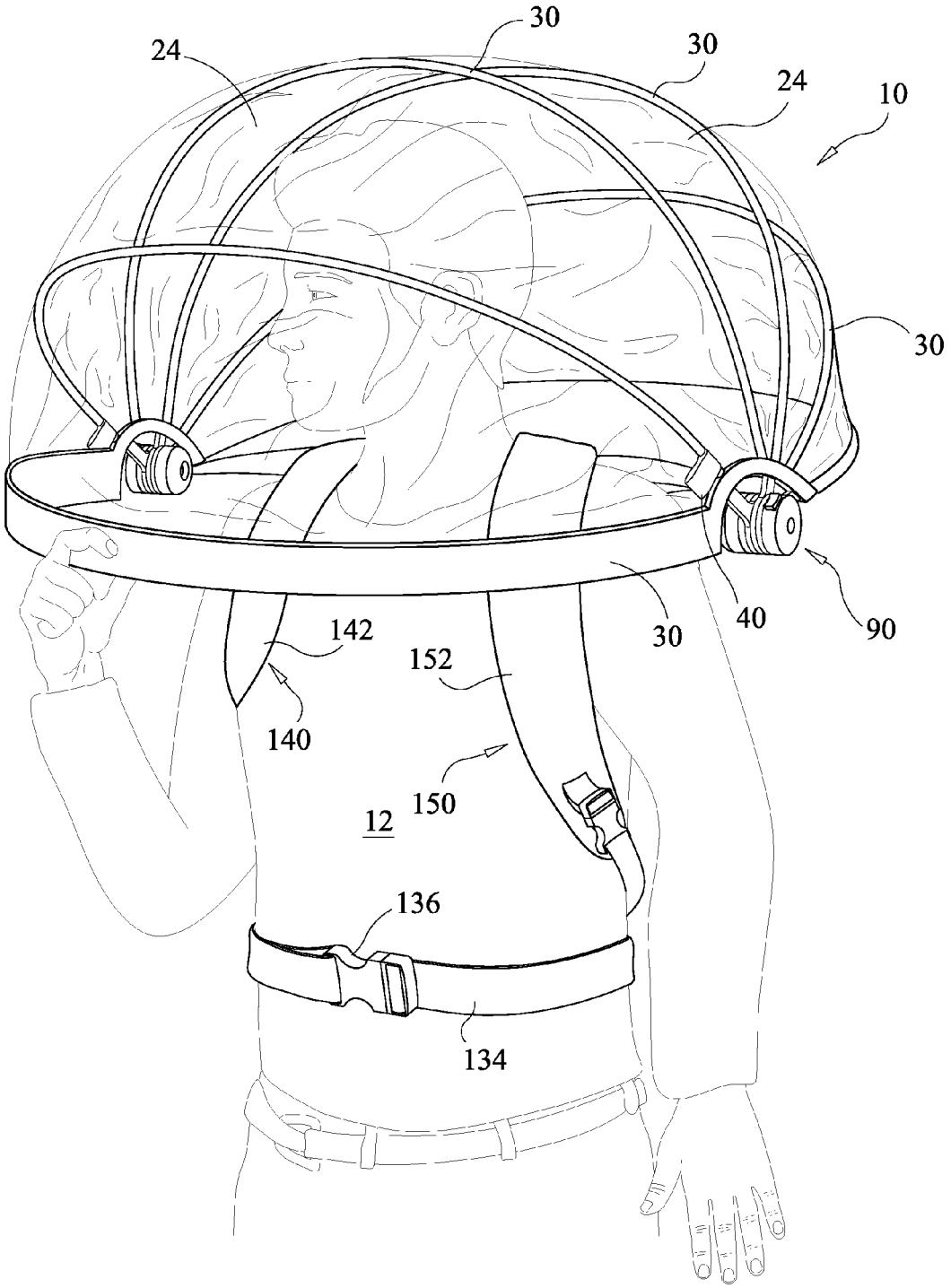
FIG. 9 is a front perspective view of a second embodiment for the wearable umbrella, which is similar to the first embodiment shown in FIG. 1, but incorporates an additional panel or a larger canopy sheet such that the canopy when extended is substantially semi-sphere like in shape and extends further over the wearer's head including in front of the wearer's face.

FIG. 9 is a front perspective view of a second embodiment for the wearable umbrella, which is similar to the first embodiment shown in FIG. 1, but incorporates an additional panel or a larger canopy sheet such that canopy 24 when fully extended is substantially semi-sphere like in shape and extends over the wearer's head including in front of the face of wearer 12. For the second embodiment, the fully extended position includes in front of the face of wearer 12.

In all embodiments, when wearable umbrella 10 is in the stored/closed position, there is minimal, if any, danger of umbrella accidentally hitting nearby objects, such as a door frame.

The disclosure and drawings for U.S. application Ser. No. 11/393,936, filed on Mar. 31, 2006 and Titled "Umbrella With Offset Handle" (Publication No. 2006/0219279) are incorporated by reference herein in its entirety.

All locations, sizes, shapes, proportions, measurements, amounts, angles, component locations, part locations, fasteners, configurations, weights, dimensions, values, percentages, materials and/or orientations discussed above or shown in the drawings are merely by way of example and are not considered limiting and other locations, sizes, shapes, proportions, measurements, amounts, angles, component locations, part locations, fasteners, configurations, weights, dimensions, values, percentages, materials and/or orientations can be chosen and used and all are considered within the scope of the invention.

Dimensions of certain parts as shown in the drawings may have been modified and/or exaggerated for the purpose of clarity of illustration and are not considered limiting.

Unless feature(s), part(s), component(s), characteristic(s) or function(s) described in the specification or shown in the drawings for a claim element, claim step or claim term specifically appear in the claim with the claim element, claim step or claim term, then the inventor does not considered such feature(s), part(s), component(s), characteristic(s) or function(s) to be included for the claim element, claim step or claim term in the claim for examination purposes and when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, modifications and equivalents suggested by the teachings herein, can be practiced without departing from the spirit of the invention, and rights to such alternatives, modifications and equivalents are particularly reserved and considered within the scope of the invention.

What is claimed is:

1. A wearable umbrella, comprising:

a support assembly having a substantially horizontal support member adapted to be worn by a wearer such that the horizontal support member extends across an upper back area of the wearer or rest on a shoulder area of the wearer; wherein said support assembly further comprises a first downwardly and inwardly extending member having a first end associated with a first side of the support member and second downwardly and inwardly extending member having a first end associated with a second side of the support member; said first downwardly and inwardly extending member having a second end and said second downwardly and inwardly extending member having a second end which meets with the second end of the first downwardly and inwardly extending member such that the first and second downwardly and inwardly extending members and the support member form a substantially inverted triangular shaped support assembly at the upper back area of the wearer when said support assembly is worn by the wearer;

a rigid back panel secured to or monolithically formed with the support member;

a first pivot assembly supported at a first side of the wearer by the support assembly;

a second pivot assembly supported at a second side of the wearer by the support assembly;

a plurality of curved ribs each having a first end and a second end, said plurality of curved ribs including a front rid and a back rib; wherein the first end of each curved rib is secured to said first pivot assembly and the second end of each curved rib is secured to said second pivot assembly; and one or more pieces of waterproof or water resistant material secured to said plurality of curved ribs to form a canopy when in an extended position;

wherein in a closed "non-use" position said plurality of curved ribs are positioned downward behind the wearer and in an open "in-use" position said plurality of curved ribs are pivoted forward to their extended position such that said front rib is positioned in front of the wearer and the back rib is positioned behind the wearer in a closer to horizontal position than vertical position with respect to the wearer.

2. The wearable umbrella of claim 1, further comprising a first tab or fabric loop secured to a first side of the front rib and a second tab or fabric loop secured to a second side of the front rib, said first tab and said second tab or said first fabric loop and said second fabric loop disposed on the front rib where they can be reached by the wearer while the wearable umbrella is being worn and while the plurality of ribs are in a collapsed position so that the wearer can pull said front rib forward while wearing the wearable umbrella.

3. The wearable umbrella of claim 1 wherein in an extended position said one or more pieces of material covers a wearer's head but is not positioned in front of a wearer's face.

4. The wearable umbrella of claim 1 wherein in an extended position said one or more pieces of material are shaped substantially like a semi-sphere and form an oval shaped canopy.

5. The wearable umbrella of claim 1 further comprising a locking mechanism disposed within the first pivot assembly or the second pivot assembly; wherein in the extended positioned said curved ribs are locked in position and maintained in position without use of a wearer's hands by said locking mechanism.

6. The wearable umbrella of claim 1 wherein said one or more pieces of waterproof or water resistant material is constructed from a sun reflective or UV protection material.

7. The wearable umbrella of claim 1 wherein said support assembly is non-adjustable and said back panel is non-adjustable, and said support assembly further comprises: a waist strap secured to said back panel which is adapted to be disposed around a wearer's waist;

a first shoulder strap assembly having a first strap portion with an upper end secured to a first side of said support assembly and a second strap portion with a lower end secured to a first lower portion of said back panel, wherein a lower end of said first strap portion is releasably secured to an upper end of the second strap portion; and a second shoulder strap assembly having a third strap portion with an upper end secured to a second side of said support assembly and a fourth strap portion with a lower end secured to a second lower portion of said rigid back panel, wherein a lower end of said thirst strap portion is releasably secured to an upper end of the fourth strap portion.

8. The wearable umbrella of claim 7 wherein said first pivot assembly secured and supported at the first end of said upper member and said second pivot assembly secured and supported at the second end of said upper member.

9. The wearable umbrella of claim 5, further comprising means for releasing the locked position of said plurality of curved ribs in their extended position, said means for releasing including a release button extending out of the first pivot assembly or the second pivot assembly.

10. The wearable umbrella of claim 9, further comprising means for automatically returning the curved ribs to their closed "non-use" position after said means for releasing has been activated or operated.

11. The wearable umbrella of claim 7 further comprising a backpack secured to said support assembly or said rigid back panel.

12. The wearable umbrella of claim 1, wherein said support assembly further comprising: a first shaft member disposed outward and substantially horizontal at a first end of the support assembly and a second shaft member disposed outward and substantially horizontal at a second end of the support assembly;

wherein said first pivot assembly comprising:

a first plurality of rib connectors pivotally positioned on the first shaft with each rib connector having a rib receiving aperture for receipt of a first end of a corresponding rib from said plurality of curved ribs; and a first stop member disposed at an outer end of the first shaft to maintain the first plurality of rib connectors on the first shaft;

wherein said second pivot assembly comprising a second plurality of rib connectors pivotally positioned on the second shaft with each rib connector of said second plurality of rib connectors having a rib receiving aperture for receipt of a second end of a corresponding rib from said plurality of curved ribs;

and a second stop member disposed at an outer end of the second shaft to maintain the second plurality of rib connectors on the second shaft;

wherein a number of rib connectors for the first plurality and the a number of rib connectors for the second plurality are the same and correspond to a number of the plurality of ribs.

13. A wearable umbrella, comprising:

a rigid back panel adapted to be secured to a wearer's back area;

a support assembly secured to or monolithically formed with said rigid back panel, said support assembly having a substantially horizontal upper support member, said support assembly adapted to be worn by the wearer such that the horizontal upper support member extends across wearer or rest on a shoulder area of the wearer; wherein said support assembly further comprises a first downwardly and inwardly extending member having a first end associated with a first side of the support member and second downwardly and inwardly extending member having a first end associated with a second side of the support member; said first downwardly and inwardly extending member having a second end and said second downwardly and inwardly extending member having a second end which meets with the second end of the first downwardly and inwardly extending member such that the first and second downwardly and inwardly extending members and the support member form a substantially inverted triangular shaped support assembly at the upper back area of the wearer when said support assembly is worn by the wearer;

a plurality of straps secured to said back panel or said support assembly for securing said back panel and support assembly to the wearer's back area;

a first pivot assembly supported at a first side of the wearer by the support assembly;

a second pivot assembly supported at a second side of the wearer by the support assembly;

a plurality of curved ribs each having a first end and a second end; wherein the first end of each curved rib is secured to said first pivot assembly and the second end of each curved rib is secured to said second pivot assembly, said plurality of curved ribs including a front rib and a back rib and at least one rib between the front rib and the back rib when in an open "in use" position; and one or more pieces of waterproof or water resistant material secured to said plurality of curved ribs to form a canopy when in an extended position;

wherein in a closed "non-use" position said plurality of curved ribs are positioned downward behind the wearer and in an open "in-use" position said plurality of curved ribs are pivoted forward to their extended position such that said front rib is positioned in front of the wearer and the back rib is positioned behind the wearer in a closer to horizontal position than vertical position with respect to the wearer.

14. The wearable umbrella of claim 13 further comprising a first tab or fabric loop secured to a first side of the front rib of said plurality of curved ribs and a second tab or fabric loop secured to a second side of the front rib, said first tab and said second tab or said first fabric loop and said second fabric loop disposed on the front rib where they can be reached by the wearer while the wearable umbrella is being worn and while the plurality of ribs are in a collapsed position so that the wearer can pull said front rib forward while wearing the wearable umbrella.

15. The wearable umbrella of claim 13 wherein in an extended position said one or more pieces of material covers a wearer's head but is not positioned in front of a wearer's face.

16. The wearable umbrella of claim 13 wherein in an extended position said one or more pieces of material are shaped substantially like a semi-sphere and form an oval shaped canopy.

17. The wearable umbrella of claim 13 further comprising a locking mechanism disposed within the first pivot assembly or the second pivot assembly; wherein in the extended positioned said curved ribs are locked in position and maintained in position without use of a wearer's hands by said locking mechanism.

18. The wearable umbrella of claim 13 wherein said one or more pieces of waterproof or water resistant material is constructed from a sun reflective or UV protection material.

19. The wearable umbrella of claim 13, wherein said support assembly further comprising: a first shaft member disposed outward and substantially horizontal at a first end of the support assembly and a second shaft member disposed outward and substantially horizontal at a second end of the support assembly;

wherein said first pivot assembly comprising:

a first plurality of rib connectors pivotally positioned on the first shaft with each rib connector having a rib receiving aperture for receipt of a first end of a corresponding rib from said plurality of curved ribs; and a first stop member disposed at an outer end of the first shaft to maintain the first plurality of rib connectors on the first shaft;

wherein said second pivot assembly comprising a second plurality of rib connectors pivotally positioned on the second shaft with each rib connector of said second plurality of rib connectors having a rib receiving aperture for receipt of a second end of a corresponding rib from said plurality of curved ribs;

and a second stop member disposed at an outer end of the second shaft to maintain the second plurality of rib connectors on the second shaft;

wherein a number of rib connectors for the first plurality and the a number of rib connectors for the second plurality are the same and correspond to a number of the plurality of ribs.

20. A wearable umbrella, comprising:

a plastic back panel adapted to be secured to a wearer's back area;

a support assembly secured to or monolithically formed with said rigid back panel, said support assembly having a substantially horizontal upper support member, a first downwardly and inwardly extending member and a second downwardly and extending member, said support assembly adapted to be worn by the wearer such that the horizontal upper support member extends across an upper back area of the wearer or rest on a shoulder area of the wearer, said first downwardly and inwardly extending member having a first end associated with a first side of the support member and said second downwardly and inwardly extending member having a first end associated with a second side of the support member; said first downwardly and inwardly extending member having a second end and said second downwardly and inwardly extending member having a second end which meets with the second end of the first downwardly and inwardly extending member such that the first and second downwardly and inwardly extending members and the upper horizontal support member form a substantially inverted triangular shaped support assembly at the upper back area of the wearer when said support assembly is worn by the wearer;

a waist strap secured to said back panel which is adapted to be disposed around a wearer's waist;

a first shoulder strap assembly having a first strap portion with an upper end secured to a first said of said support assembly and a second portion with a lower end secured to a first lower portion of said back panel, wherein a lower end of said first strap portion is releasably secured to an upper end of the second strap portion; and a second shoulder strap assembly having a third strap portion with an upper end secured to a second side of said support assembly and a fourth strap portion with a lower end secured to a second lower portion of said rigid back panel, wherein a lower end of said thirst strap portion is releasably secured to an upper end of the fourth strap portion, a first pivot assembly secured to the first end of the upper member and supported at a first side of the wearer;

a second pivot assembly secured to the second end of the support member and supported at a second side of the wearer;

a plurality of curved ribs each having a first end and a second end; wherein the first end of each curved rib is secured to said first pivot assembly and the second end of each curved rib is secured to said second pivot assembly, said plurality of curved ribs including a front rib and a back rib and at least one rib between the front rib and the back rib when in an open "in use" position;

one or more pieces of waterproof or water resistant and sun reflective or UV protective material secured to said plurality of curved ribs to form a canopy when in an extended position;

a first tab or fabric loop secured to a first side of the front rib of said plurality of curved ribs;

a second tab or fabric loop secured to a second side of the front rib, said first tab and said second tab or said first fabric loop and said second fabric loop disposed on the front rib where they can be reached by the wearer while the wearable umbrella is being worn and while the plurality of ribs are in a collapsed position so that the wearer can pull said front rib forward while wearing the wearable umbrella;

wherein in a closed "non-use" position said plurality of curved ribs are positioned downward behind the wearer and in an open "in-use" position said plurality of curved ribs are pivoted forward to their extended position;

a locking mechanism disposed within the first pivot assembly or the second pivot assembly; wherein in the extended positioned said curved ribs are locked in position and maintained in position without use of a wearer's hands by said locking mechanism;

a first shaft member disposed outward and substantially horizontal at a first end of the support assembly; and a second shaft member disposed outward and substantially horizontal at a second end of the support assembly;

wherein said first pivot assembly comprising:

a first plurality of rib connectors pivotally positioned on the first shaft with each rib connector having a rib receiving aperture for receipt of a first end of a corresponding rib from said plurality of curved ribs; and a first stop member disposed at an outer end of the first shaft to maintain the first plurality of rib connectors on the first shaft;

wherein said second pivot assembly comprising a second plurality of rib connectors pivotally positioned on the second shaft with each rib connector of said second plurality of rib connectors having a rib receiving aperture for receipt of a second end of a corresponding rib from said plurality of curved ribs;

and a second stop member disposed at an outer end of the second shaft to maintain the second plurality of rib connectors on the second shaft;

wherein a number of rib connectors for the first plurality and the a number of rib connectors for the second plurality are the same and correspond to a number of the plurality of ribs.

* * * * *